US005878516A

United States Patent [19]

Amirian

[11] Patent Number: 5,878,516

[45] Date of Patent: Mar. 9, 1999

[54] VEHICLE BILLBOARD

[76] Inventor: Partev Amirian, 108 Elder Dr., Mastic Beach, N.Y. 11951

[21] Appl. No.: 820,266

[22] Filed: Mar. 18, 1997

[51] Int. Cl.[6] ..... G09F 21/04

[52] U.S. Cl. ..... 40/591; 40/209; 40/210; 40/606; 248/300

[58] Field of Search ..... 40/209, 210, 591, 40/606, 643; 248/300

[56] References Cited

U.S. PATENT DOCUMENTS

| | | | |
|---|---|---|---|
| 1,371,837 | 3/1921 | Ard | 248/300 |
| 1,575,950 | 3/1926 | Thorn | 40/210 X |
| 2,636,299 | 4/1953 | McDermott | 40/210 |
| 2,802,292 | 8/1957 | Bader | 40/591 |
| 2,880,535 | 4/1959 | Bryant | 40/210 |
| 2,921,395 | 1/1960 | Fishman | 40/209 |
| 2,935,281 | 5/1960 | Huffman | 248/475.1 |
| 3,166,280 | 1/1965 | Paruskiewicz | 40/210 X |
| 3,173,219 | 3/1965 | Yarder | 40/591 |
| 3,509,653 | 5/1970 | Hummel | 40/591 |
| 3,791,337 | 2/1974 | Schamblin | 116/28 R |
| 4,471,991 | 9/1984 | Matthias | 248/300 X |
| 4,953,339 | 9/1990 | Jewell | 248/300 X |
| 5,027,537 | 7/1991 | Freeman et al. | 40/210 |
| 5,307,860 | 5/1994 | Wilkinson et al. | 248/300 X |

FOREIGN PATENT DOCUMENTS

| | | | |
|---|---|---|---|
| 995897 | 12/1951 | France | 40/606 |

*Primary Examiner*—Kenneth J. Dorner
*Assistant Examiner*—Andrea Chop

[57] ABSTRACT

A vehicle billboard which permits the removable attachment of a sign-bearing billboard to the existing license plate frame of a vehicle. The billboard is fixedly mounted to a supporting frame and has a flat surface upon which a design may be affixed, drawn or otherwise displayed. A pair of brackets join the supporting frame and billboard to a license plate frame via screws or rivets. The billboard and supporting frame may be interchanged with other billboards and the entire apparatus including the mounting brackets may be easily attached to or removed from a vehicle.

9 Claims, 2 Drawing Sheets

VEHICLE BILLBOARD

FIELD OF INVENTION

The present invention generally relates to the field of signs which may be attached to an vehicle, and more particularly to a billboard which may be secured to a vehicle by means of a pair of mounting brackets attachable to a vehicle's license plate by a pair of mounting brackets. The billboard may be provided with a personalized design or message or may serve as a surface to which a bumper sticker-type decal may be attached. The mounting brackets may remain affixed to the vehicle's license plate while the billboard itself is removably mounted thereto. In this manner, the inventive vehicle billboard can be quickly and easily interchanged with another billboard carrying a different personalized design or message.

BACKGROUND OF THE INVENTION

Vehicle owners have long recognized that their vehicles can be an effective means of displaying a humorous message, support for a political candidate or a personal belief. For the most part, the use of such messages has been confined to bumper stickers and to a lesser extent, to personalized vanity plates. In addition, numerous forms of advertising, including the promotion of one's business, have been displayed on automobiles, vans and trucks. Likewise, many vehicle owners today are attaching varying identifying means to their vehicle, for example, ribbons tied to the vehicle's attenna, for locating their vehicle in overcrowded parking lots and garages.

While bumper stickers have long been used by vehicle owners to express personal beliefs, to advertise products, to share humor with occupants of other vehicles, to provide information etc., a significant drawback to the use of bumper stickers is that they are constructed to adhere tightly to the vehicle frame for long durations and may be difficult if not impossible to remove when the time for them has passed. Moreover, the adhesives used on bumper stickers may leave a sticky residue on the vehicle even when the bumper sticker has been completely removed. In addition, a bumper sticker generally provides a fairly small space for displaying a message, thereby limiting the content and size of the message.

The use of advertising on vehicles is generally confined to either a message or company logo painted (detailed) directly onto the vehicle (e.g. Smith & Sons Plumbing) or painted onto removable magnetic signs. Both of these means of advertising also have great disadvantages. The direct painting onto a vehicle results in a near-permanent alteration which only can be removed or altered by painting thereover. Although the use of magnetic signs has allowed the vehicle owner to preserve the original exterior of the vehicle, these signs are expensive to purchase and create an additional burden to the vehicle owner in that the owner generally removes and stores the signs when not in use.

Attempts have been made to provide display panels which may be attached to a vehicle. For example, U.S. Pat. No. 4,445,291, issued May 1, 1984 to R. E. Easley discloses a modified license plate frame to which detachable display panels may be mounted. Panels may be mounted to the innovative frame from each of four sides. The license plate itself is framed by the apparatus and the panels are interchangeable.

U.S. Pat. No. 1,575,950, issued Mar. 9, 1926 to L. T. Thorn shows a license tag holder having a holder for a license plate, a supporting bracket for attaching the apparatus to a vehicle and sealing means that prevent one from tampering with the displayed license.

U.S. Pat. No. 3,060,605, issued Oct. 30, 1962 to P. M. Flack and U.S. Pat. No. 3,791,337, issued Feb. 12, 1974 to C. H. Schamblin disclose signalling devices that may be attached to the vehicle frame such as the bumper or a door frame. Moreover, U.S. Pat. No. 2,496,763, issued Feb. 7, 1950 to W. E. Whaley discloses a display card holder for automobiles that may be attached to a panel of the vehicle.

Despite the teachings of the prior art, a need still exists for a vehicle billboard that facilitates mounting an individual display to a vehicle. Such a vehicle billboard should be easily attached to or removed from a vehicle and provide a surface that is large enough to display a desired message or design. Such a vehicle billboard also should provide means for interchangeable billboards so that a user may readily change the message or design as needed or desired.

SUMMARY OF THE INVENTION

Accordingly, it is an object of the present invention to provide a vehicle billboard in which the aforementioned problems can be overcome and which comprises a billboard member and a pair of mounting brackets with which the billboard member may be mounted to the license plate frame of a vehicle.

It is another object of the present invention to provide a vehicle billboard in which interchangeability of the billboard permits a user to change the display of a desired message or sign.

It is an additional object of the present invention to provide a vehicle billboard which may be easily and quickly attached to or removed from the license plate frame of a vehicle.

It is a still further object of the present invention to provide a vehicle billboard which is economical to manufacture, durable in construction and effective in operation.

Additional objects, advantages and novel features of the present invention will be set forth in part in the description which follows and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

BRIEF DESCRIPTION OF THE DRAWINGS

The present invention will be better understood with reference to the appended drawing sheets, wherein.

DETAILED DESCRIPTION

It will be appreciated that the present invention can take many forms and embodiments. Some embodiments of the invention are described so as to give an understanding of the invention. It is not intended that the illustrative embodiments described herein should limit the invention.

Figure 1:
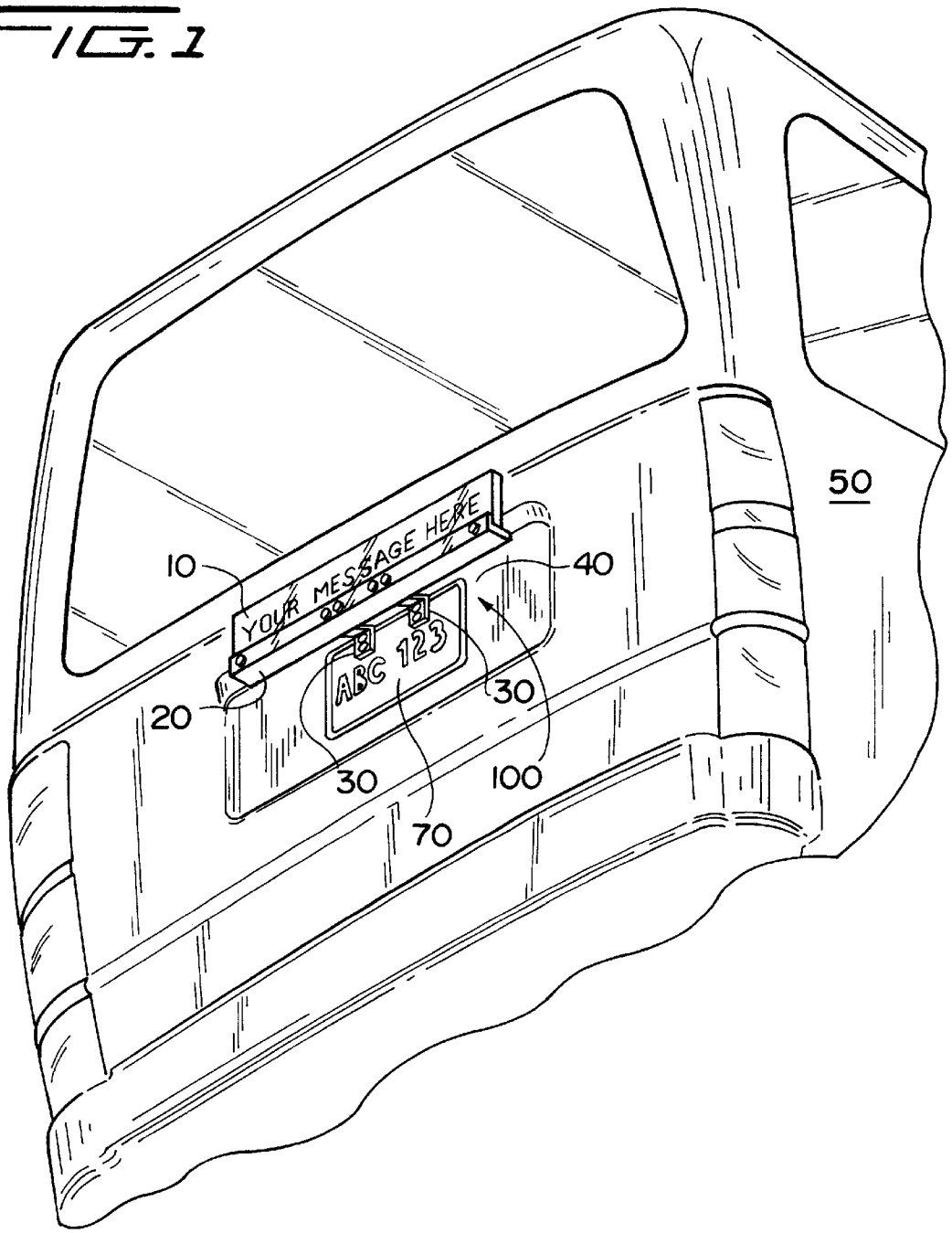
FIG. 1 is an environmental perspective view of the vehicle billboard of the present invention.
Figure 2:
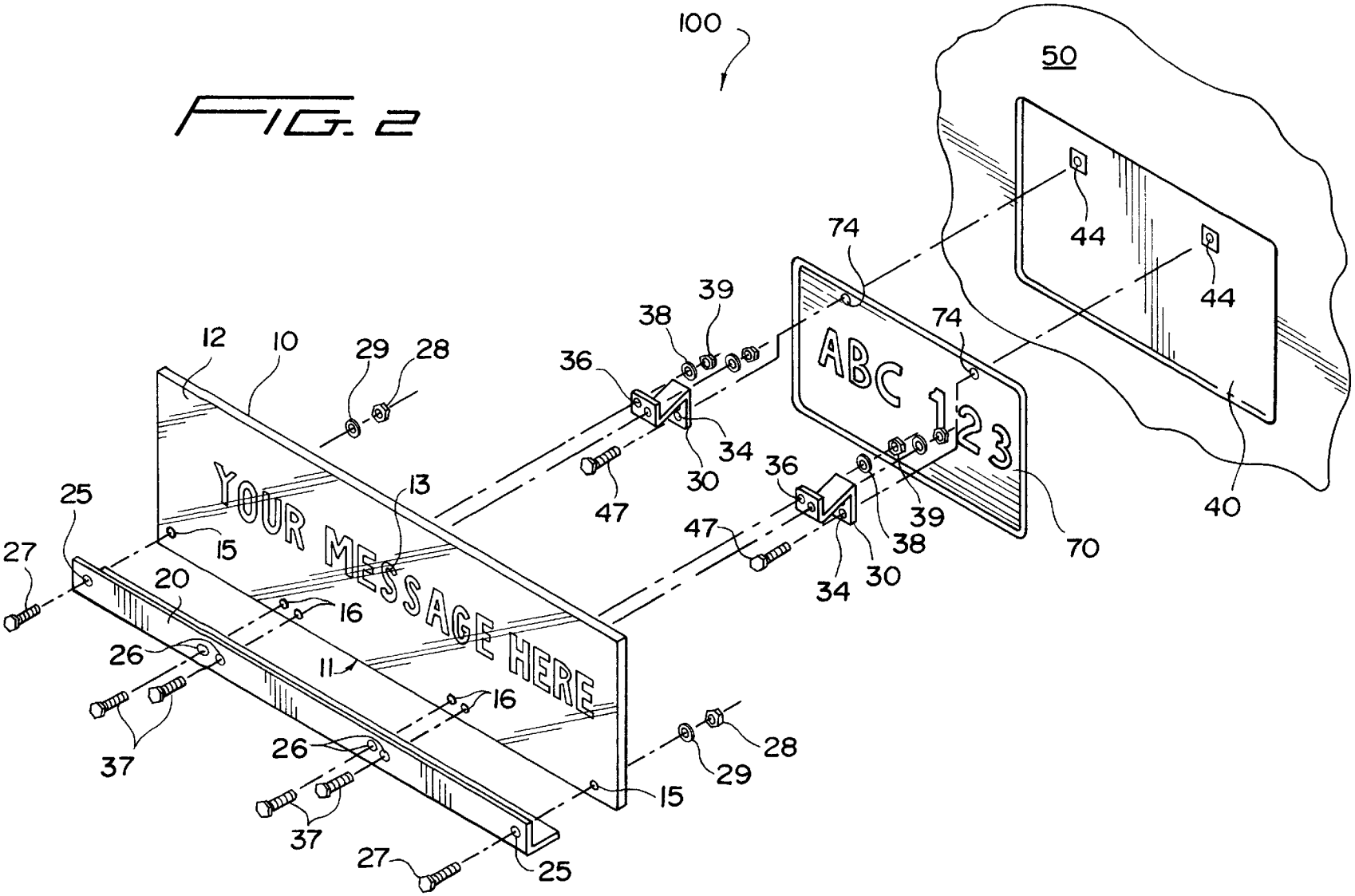
FIG. 2 is an exploded side perspective view of the vehicle billboard of the present invention.

The vehicle billboard comprises a billboard member and a pair of mounting brackets. Referring to FIGS. 1 and 2, there is shown a vehicle billboard invention generally designated 100 secured to a license plate mount 40 of a vehicle 50 comprising (1) a billboard member consisting of a billboard 10 and a supporting frame 20 and (2) a pair of mounting brackets 30. The billboard 10 is in the form of a flat piece of substantially rigid material having a bottom edge 11 and a front surface 12 on which a message 13 may be displayed. As shown, the billboard 10 is rectangular in shape; however, it should be understood that both the billboard 10 and the front surface 12 may be of any practicable dimensions and may be of any desired shape. For instance the front surface 12 may be circular instead of rectangular or may be patterned after the shape of a company logo or mascot. Suitable construction materials for the billboard include wood, plastic, fiberglass, metal, hardened rubber or glass. Preferably, the billboard is constructed from plexi-glass. The billboard is provided with several holes 15 and 16 that are used in mounting.

A supporting frame 20 having an L-shaped cross section and holes 25 and 26 is attached to the billboard 10 by threaded bolts 27 which penetrate matching holes 15 and 25. Nuts 28 and washers 29 are affixed to the bolts 27 to secure the supporting frame 20 to the bottom edge 11 of the billboard 10. Although a threaded bolt and nut arrangement is shown in the drawings, it is to be understood that other conventional securing means, including for example, rivets or spring-loaded clamps, may be used where the bolt/nut arrangement is not desired. Alternatively, rather than the billboard member being composed of two separate elements, the billboard and supporting frame can be of a one-piece construction.

A pair of mounting brackets 30 comprising metal strips having Z-shaped cross sections are used to join the supporting frame 20 to the license plate mount 40 of a vehicle 50. Because the mounting brackets are identical, reference will be made to a single bracket, but it should be understood that the second bracket is implied by this reference. The mounting bracket 30 comprises a first end surface 31 having holes 36 disposed therein and a second end surface 32 having at least one hole 34 disposed therein. Holes 36 correspond to and are in register with holes 16 of the billboard and holes 26 of the supporting frame 20 such that the mounting brackets 30 can be secured to billboard and the supporting frame 20 by means of threaded bolts 37 which penetrate holes 36, 16 and 26 and are secured thereto by conventional means, such as washers 38 and nuts 39. If permanent attachment between the supporting frame 20 and the bracket 30 is desired, bolts 37 may be replaced with rivets having a terminal flange.

The second end surface 32 of mounting bracket 30 is configured with at least one hole 34. A plurality of holes 34 may be vertically disposed within the second end surface 32 as shown in FIG. 2 in order to provide the user with alternative mounting options. To secure each mounting bracket to the vehicle, hole 34 is aligned with one of the existing holes 74 disposed along the top edge of license plate 70 and a threaded screw or bolt 47 fastens the mounting bracket and license plate to the corresponding threaded mounting receptacle 44 located on the vehicle's license plate mount 40. As is clearly shown in FIG. 1, the mounted billboard is suspended away from the vehicle and does not block the view of the license plate. Both the supporting frame and the mounting brackets are preferably made from worked metal, and most preferably from aluminum or zinc plated aluminum.

In use, the vehicle billboard 100 as assembled is detachable from the vehicle by engaging screws 47. When a user desires to change the message displayed on the billboard 10, the billboard simply is removed from the supporting frame 20 by engaging screws 27 and can be replaced with an interchangeable second billboard. The mounting brackets 30 need not be removed from the supporting frame 20 while replacing the first billboard with a second.

What is claimed is:

1. A vehicle billboard system for removably attaching at least one interchangeable vehicle billboard to a vehicle having a license plate mount comprising:

(1) a billboard member comprising:

(a) a billboard in the form of a substantially rigid material having a front surface for displaying a message and a bottom edge, and (b) a supporting frame being detachably secured to said bottom edge of said billboard by a first fastening means;

(2) a pair of mounting brackets, each of said mounting brackets being configured with a Z-shaped cross section and having a first end and a second end, each of said first ends being laterally displaced from each of said respective second ends, each of said first ends being detachably secured to said billboard and said supporting frame by a second fastening means.

2. The vehicle billboard system of claim 1, wherein said first fastening means comprises a nut and bolt arrangement.

3. The vehicle billboard system of claim 1, wherein said second fastening means comprises a nut and bolt arrangement and said first fastening means is selected from the group consisting of a bolt or a threaded screw.

4. The vehicle billboard system of claim 1, wherein said billboard is constructed from a material selected from the group consisting of wood, plastic, fiberglass, metal, hardened rubber or glass.

5. The vehicle billboard system of claim 1, wherein each of said first ends of said of said pair of mounting brackets has at least one mounting hole.

6. The vehicle billboard system of claim 1, wherein said supporting frame and said pair of mounting brackets are constructed from a metal.

7. The vehicle billboard system of claim 6, wherein said metal is selected from the group consisting of aluminum or zinc-plated-aluminum.

8. A vehicle billboard system for removably attaching at least one interchangeable vehicle billboard to a vehicle having a license plate mount comprising:

(1) a billboard member comprising:

(a) a billboard in the form of a substantially rigid material having a front surface for displaying a message and a bottom edge, and (b) a supporting frame being detachably secured to said bottom edge of said billboard by a first fastening means selected from the group consisting of a nut and bolt arrangement or a threaded screw arrangement;

(2) a pair of mounting brackets, each of said mounting brackets being configured with a Z-shaped cross section and having a first end and a second end, each of said first ends being laterally displaced from each of said respective second ends, each of said first ends being detachably secured to said supporting frame by a nut and bolt arrangement.

9. A vehicle billboard system for removably attaching at least one interchangeable vehicle billboard to a vehicle having a license plate mount comprising:

(1) a billboard member comprising:

(a) a billboard in the form of a substantially rigid material having a front surface for displaying a message and a bottom edge, and (b) a supporting frame having a first edge and a second edge, said first and second edges being disposed in different planes and one of said first edge and said second edge being detachably secured to said bottom edge of said billboard by a first fastening means;

(2) a pair of mounting brackets, each of said mounting brackets being configured with a Z-shaped cross section and having a first end and a second end, each of said first ends being laterally displaced from each of said respective second ends, each of said first ends being detachably secured to said billboard and said supporting frame by a second fastening means.

* * * * *